United States Patent [19]

Ruane

[11] Patent Number: 4,739,971

[45] Date of Patent: Apr. 26, 1988

[54] GUARD RAIL ASSEMBLY

[76] Inventor: George W. Ruane, 230 W. McMillan St., Cincinnati, Ohio 45219

[21] Appl. No.: 22,118

[22] Filed: Mar. 5, 1987

[51] Int. Cl.[4] ..... A01K 3/00; E04H 17/14

[52] U.S. Cl. ..... 256/13.1; 256/19; 248/66; 114/219

[58] Field of Search ..... 256/13.1, 19; 248/66; 114/219

[56] References Cited

U.S. PATENT DOCUMENTS

| | | | |
|---|---|---|---|
| 1,449,518 | 3/1923 | Lawson | 256/13.1 |
| 1,847,025 | 2/1932 | Stockard | 256/13.1 |
| 3,084,517 | 4/1963 | Bell | 114/220 X |
| 4,330,106 | 5/1982 | Chisholm | 256/13.1 |
| 4,662,611 | 5/1987 | Ruowe | 256/13.1 |

FOREIGN PATENT DOCUMENTS

| | | | |
|---|---|---|---|
| 2148219 | 4/1973 | Fed. Rep. of Germany | 256/13.1 |
| 1522918 | 3/1968 | France | 256/13.1 |

*Primary Examiner*—Andrew V. Kundrat

*Attorney, Agent, or Firm*—James W. Pearce; Roy F. Schaeperklaus

[57] ABSTRACT

A guard rail assembly for a highway. A sliding frame is mounted on each of a series of posts. The sliding frame slides transversely of the guard rail assembly. Elongated guard rail units span adjacent posts. Each guard rail unit includes an elongated support plate, hanger means on the sliding frames of the adjacent posts for supporting opposed end portions of the support plates, a sliding plate mounted on the support plate for frictional engagement therewith, and shock absorber means on each of the sliding frames for resisting movement thereof transversely of the guard rail assembly. The sliding plate can be engaged by a vehicle leaving the highway. The vehicle is restrained by the sliding plate and by resistance of the shock absorber means.

2 Claims, 2 Drawing Sheets

GUARD RAIL ASSEMBLY

BACKGROUND OF THE INVENTION

This invention relates to a highway guard rail. More particularly, this invention relates to a guard rail assembly in which sections can yield to absorb a blow against the guard rail structure.

This invention represents an improvement over the guard rail structure shown and claimed in my copending application Ser. No. 06/833,152 filed Feb. 27, 1986 and now U.S. Pat. No. 4,662,611.

An object of this invention is to provide a guard rail having sections which can yield lengthwise and also transversely of the guard rail when engaged by a vehicle.

BRIEF DESCRIPTION OF THE INVENTION

Briefly, this invention provides a guard rail which includes a plurality of section assemblies each including a support plate member and a slide plate member. The slide plate member of each section assembly can slide lengthwise of the guard rail assembly when hit by a vehicle while bearing on the support plate member. The support plate member is anchored against substantial lengthwise sliding. The support plate member is mounted for limited movement transversely of the length of the guard rail structure, and shock absorber means is provided to resist such transverse movement of the support plate members.

The above and other objects and features of the invention will be apparent to those skilled in the art to which this invention pertains from the following detailed description and the drawings, in which:

BRIEF DESCRIPTION OF THE DRAWINGS

In the following detailed description and the drawing, like reference characters indicate like parts.

DESCRIPTION OF PRESENTLY PREFERRED EMBODIMENT

Figure 1:
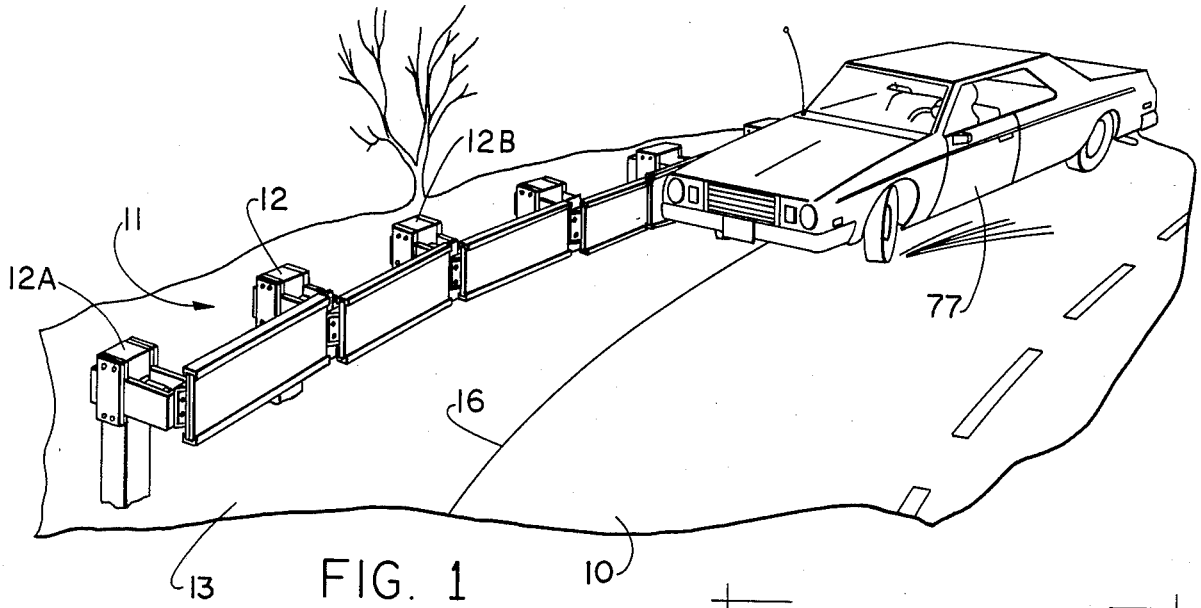
FIG. 1 is a perspective view of a fragmentary portion of a highway provided with a guard rail assembly constructed in accordance with an embodiment of this invention, a vehicle being shown in association therewith.
Figure 2:
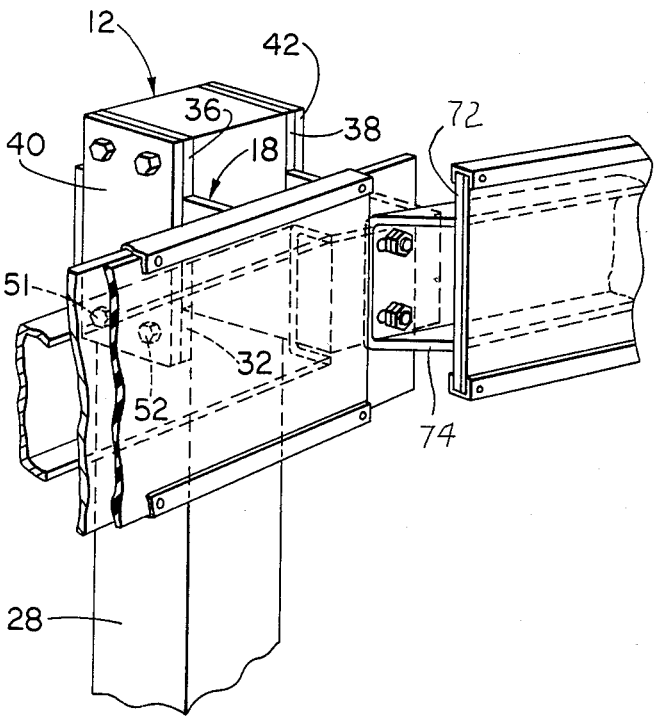
FIG. 2 is a fragmentary perspective view on an enlarged scale of a post and associated elements of the guard rail assembly.
Figure 3:
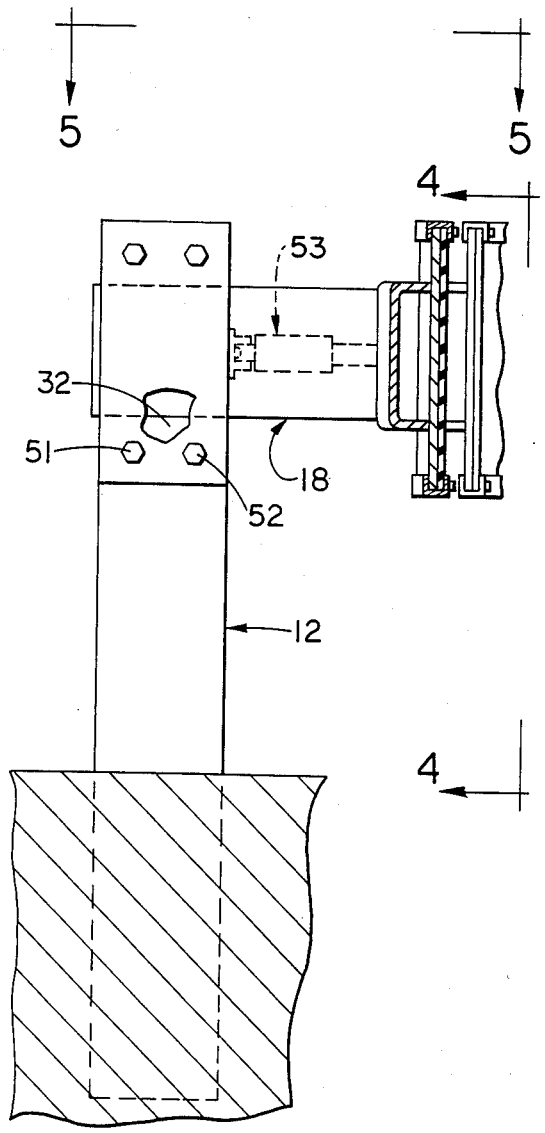
FIG. 3 is a view in upright section of the post and related elements of the guard rail assembly.
Figure 4:
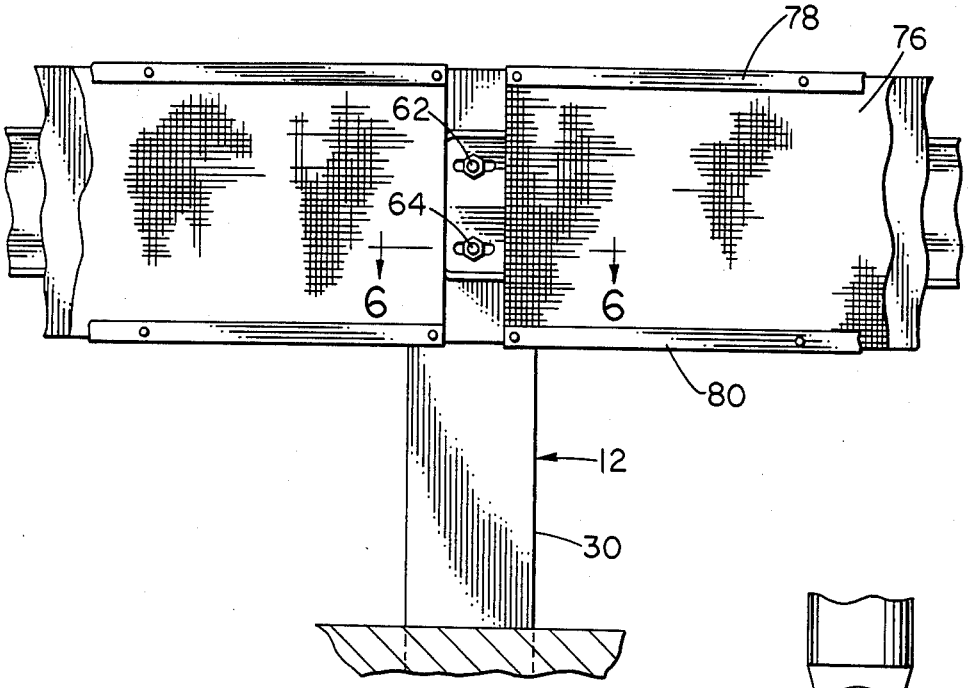
FIG. 4 is a view in section taken on the line 4—4 in FIG. 3.

In FIG. 1 of the drawings is shown a fragmentary portion of a highway 10 adjacent which is mounted a guard rail assembly 11 constructed in accordance with an embodiment of this invention. The guard rail assembly includes a plurality of upright posts 12. The posts 12 are mounted in ground 13 along a line (not shown in detail) spaced from an edge 16 of the highway 10. Each of the posts 12 can be substantially square in horizontal cross section. The posts are similar in construction and only one post 12 will be described in detail. A sliding frame 18 (FIG. 3) is slideably mounted on the post 12. The sliding frame 18 includes side plate members 20 and 22 and end plate members 24 and 26. The side plate members 20 and 22 fit against side faces 28 and 30 of the post 12. Support plates 32 (only one of which is shown) mounted on the side faces 28 and 30 support and side plate members 20 and 22, respectively. Hold down plates 36 and 38 are mounted on the side faces 28 and 30 above the side plate members 20 and 22, respectively. A cover plate 40 overlies the side plate member 20, the support plate 32 and the hold down plate 36. A cover plate 42 overlies the side plate member 22, a support plate (not shown) and the hold down plate 38. Bolts 44 and 46, which are received in sockets 48 and 50, respectively, in the post 12, and bolts 51 and 52, which are received in similar sockets (not shown in detail) in the post 12, hold the support plate 32, the side plate members 20 and 22, the hold down plates 36 and 38, and the cover plates 40 and 42 in assembled relation on the post 12.

Figure 6:
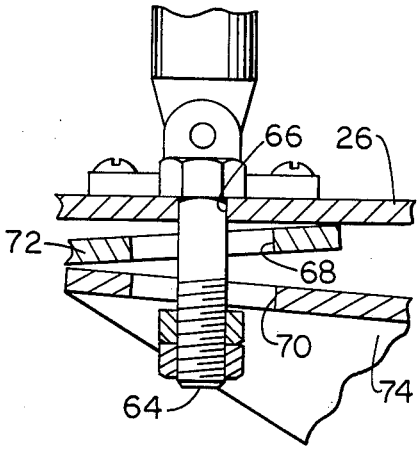
FIG. 6 is a view in section on an enlarged scale taken on the axis of a support bolt of the guard rail assembly.

A shock absorber member 53 connects the post 12 to the end plate member 26 of the sliding frame 18. A mount 54 is mounted on the post 12 and pivotally supports one end of a main member 56 of the shock absorber member 53. A mount member 58 is mounted on an inner face 59 of the end plate member 26 and pivotally supports an opposed end of a smaller member 60 of the shock absorber 53. Heads of bolt members 62 and 64 are welded to the end plate member 26. Details of construction of the bolt member 64 are shown in FIG. 6. The bolt member 64 extends through a bore 66 in the end wall member 26 and through slots 68 and 70 in a support plate 72 and in a stiffener channel 74, respectively. The support plate 72 is a part of a guard rail unit extending between the post 12 and a downstream post 12A. The stiffener channel 74 is a part of a guard rail assembly extending between the post 12 and an upstream post 12B. The units are similar in structure and only one guard rail unit will be described in detail.

The guard rail unit includes the support plate 72 to which edges of flanges of the stiffener channel 74 are welded to give a sturdy support structure. The support structure can float on the bolt members 62 and 64 lengthwise of the guard rail assembly sufficiently to absorb expansion and contraction caused by temperature changes and the like. A slide plate 76 is supported on the support plate 72 by means of upper and lower guide channels 78 and 80 which are slideably mounted on upper and lower edge portions of the support plate 72. The slide plate 76 can be formed of resilient rubber or other rubber-like material to withstand shock of impact by a vehicle 77.

Figure 5:
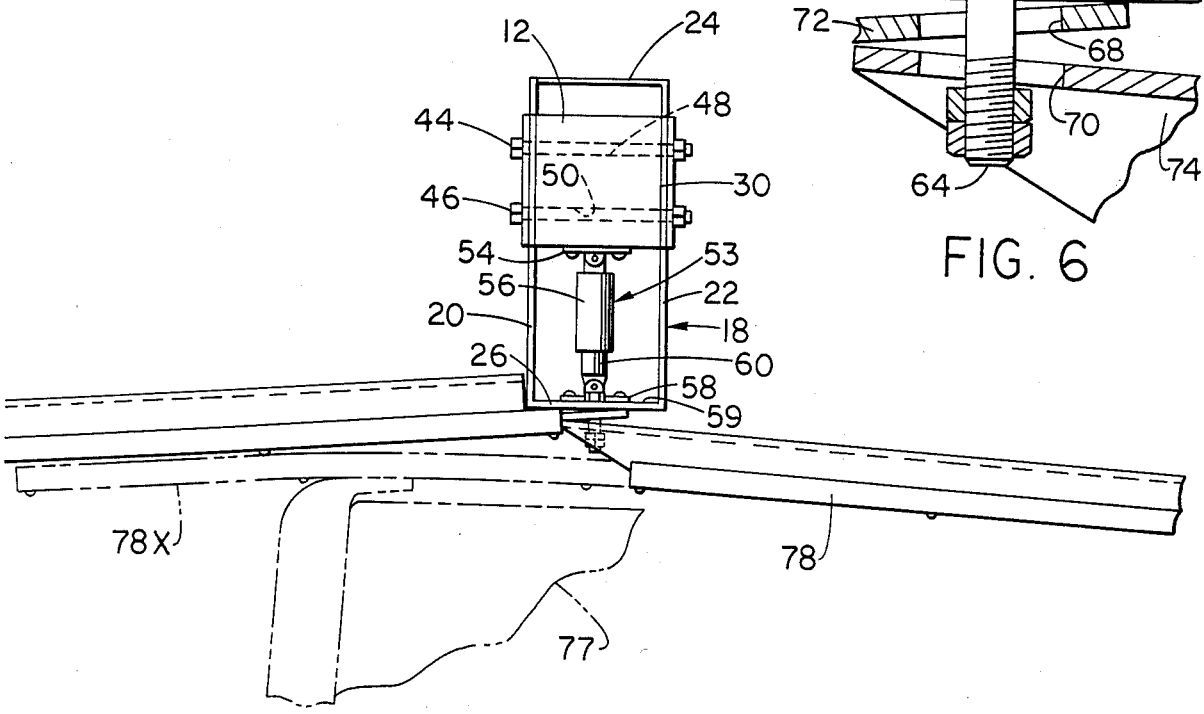
FIG. 5 is a plan view of the post and fragmentary portions of related elements looking in the direction of the arrows 5—5 in FIG. 3, a fragmentary portion of the vehicle and of a slide plate member in displaced position being shown in double dot-dash-lines.

When the vehicle 77 runs off the highway 10 and engages the guard rail assembly, one of the slide plates 76 can be engaged by the vehicle 77 and advances lengthwise of the guard rail assembly as indicated at 78*x* in FIG. 5. The shock absorber 53 can resist transverse stresses and friction between the support plates and the sliding plates can absorb stresses lengthwise of the guard rail assembly. As one sliding plate slides off its associated support plate, the next sliding plate can be engaged so that there is progressive resistance to vehicle advance lengthwise of the guard rail assembly without abrupt stoppage of the vehicle.

The guard rail assembly illustrated in the drawings and described above is subject to structural modification without departing from the spirit and scope of the appended claims.

Having described my invention, what I claim as new and desire to secure by Letters Patent is:

1. A guard rail assembly for a highway which comprises a line of upright posts mounted adjacent an edge of the highway, a sliding frame mounted on each of the posts for sliding transversely of the guard rail assembly, elongated guard rail units spanning adjacent posts, each guard rail assembly unit including an elongated support plate, hanger means on the sliding frames of the adjacent post for supporting opposed end portions of the support plate, a sliding plate mounted on the support plate for frictional engagement therewith, shock absorber means on each of the sliding frames for resisting movement thereof transversely of the guard rail assembly, the sliding plate being engageable by a vehicle leaving the highway, the vehicle being restrained by the sliding plate and by resistance of the shock absorber means, and track members carried by the sliding plate along upper and lower edges, the track members being guided by the support plate, the sliding plate being arranged to slide off an end of the support plate as the vehicle advances to another guard rail assembly.

2. A guard rail assembly for a highway which comprises a line of upright posts mounted adjacent an edge of the highway, elongated guard rail units spanning adjacent posts, each guard rail assembly unit including an elongated support plate, hanger means on the adjacent post for supporting opposed end portions of the support plate, a sliding plate mounted on the support plate for frictional engagement therewith and for movement lengthwise thereof, the sliding plate being engageable by a vehicle leaving the highway, the vehicle being restrained by the sliding plate, and track members carried by the vehicle being restrained by the sliding plate, and track members carried by the sliding plate along upper and lower edges, the track members being guided by the support plate, the sliding plate being arranged to slide off an end of the support plate as the vehicle advances to another guard rail assembly.

* * * * *